US009638145B2

(12) United States Patent
Itoh et al.

(10) Patent No.: US 9,638,145 B2
(45) Date of Patent: May 2, 2017

(54) FUEL-VAPOR LEAKAGE DETECTOR

(71) Applicant: DENSO CORPORATION, Kariya, Aichi-pref. (JP)

(72) Inventors: Tomohiro Itoh, Tokai (JP); Shigeru Hasegawa, Nagoya (JP); Kosei Takagi, Nagoya (JP); Ryoyu Kishi, Obu (JP)

(73) Assignee: DENSO CORPORATION, Kariya (JP)

( * ) Notice: Subject to any disclaimer, the term of this patent is extended or adjusted under 35 U.S.C. 154(b) by 109 days.

(21) Appl. No.: 14/640,143

(22) Filed: Mar. 6, 2015

(65) Prior Publication Data

US 2015/0252756 A1 Sep. 10, 2015

(30) Foreign Application Priority Data

Mar. 7, 2014 (JP) ..... 2014-44820

(51) Int. Cl.
*F02M 25/08* (2006.01)

(52) U.S. Cl.
CPC ..... *F02M 25/089* (2013.01); *F02M 25/0809* (2013.01); *F02M 25/0818* (2013.01); *F02M 25/0872* (2013.01)

(58) Field of Classification Search
CPC ..... F02M 25/089; F02M 25/0809; F02M 25/0818; F02M 25/0872
See application file for complete search history.

(56) References Cited

U.S. PATENT DOCUMENTS

2009/0148329 A1 6/2009 Kobayashi et al.

FOREIGN PATENT DOCUMENTS

JP 2005-069103 3/2005
JP 2005-69103 A * 3/2005 ..... F02M 25/08

* cited by examiner

*Primary Examiner* — Carlos A Rivera
*Assistant Examiner* — Kevin Lathers
(74) *Attorney, Agent, or Firm* — Nixon & Vanderhye P.C.

(57) ABSTRACT

A housing receiving a switching valve, a pressure sensor, and a pump includes a tubular portion having an inner wall provided with a support portion into which an attachment portion is inserted. The pump includes a pump portion and a motor portion which are connected to the attachment portion. The support portion receives an elastic member abutting on the attachment portion. The elastic member prevents a vibration generated due to an operation of the pump from being transmitted to the tubular portion. Since the pump is supported by a cover through a pressure detection pipe including a pressure detection passage and is supported by the tubular portion through the elastic member and the support portion, the pump prevents from vibrating by its weight. Therefore, a noise radiated out of the housing due to the vibration transmitted from the pump to the housing can be reduced.

4 Claims, 5 Drawing Sheets

FUEL-VAPOR LEAKAGE DETECTOR

CROSS REFERENCE TO RELATED APPLICATION

This application is based on Japanese Patent Application No. 2014-44820 filed on Mar. 7, 2014, the disclosure of which is incorporated herein by reference.

TECHNICAL FIELD

The present disclosure relates to a fuel-vapor leakage detector.

BACKGROUND

Conventionally, a fuel-vapor leakage detector detects a leakage of a fuel vapor of a fuel tank and a canister which collects fuel vapor in the fuel tank. The fuel-vapor leakage detector includes a pump which pressurizes or reduces a pressure in the fuel tank and a pressure in the canister, a pressure sensor which detects the pressure in the fuel tank and the pressure in the canister, and a housing which receives the pump and the pressure sensor. According to Japanese Patent No. 4543437, the pump includes a pump portion which suctions air in the fuel tank and discharges the air to external, and a motor portion which rotationally drives a rotational member rotationally receiving the pump portion. Further, an elastic sheet preventing vibration is provided between the pump portion and the motor portion.

However, when the pump and the pressure sensor are integrated as a module to be received in the housing, the pump is connected to the housing through a pipe in which the pressure sensor is provided. Since the pipe connected to the fuel tank is connected to an end portion of the pump portion, the pump is supported by the pipe. Therefore, the elastic sheet cannot suppress the vibration generated by a weight of the pump.

SUMMARY

It is an object of the present disclosure to provide a fuel-vapor leakage detector reducing a noise generated due to a vibration.

According to an aspect of the present disclosure, the fuel-vapor leakage detector detects a leakage of a fuel vapor of a fuel tank and a canister which collects the fuel vapor in the fuel tank. The fuel-vapor leakage detector includes a housing, a canister connection-passage forming member, an atmosphere-passage forming member, a pressure-detecting passage forming member, a switching valve, a pressure regulation portion, a bypass-passage forming member, a throttle portion, and a pressure detection portion. The canister connection-passage forming member forms a canister connection passage communicating with the canister. The atmosphere-passage forming member forms an atmosphere passage communicating with external atmosphere. The pressure-detecting passage forming member form a pressure detection passage that is connected to the housing and can communicate with the canister connection passage. The switching valve selectively switches between a first communication state in which the canister connection passage communicates with the pressure detection passage and a second communication state in which the canister connection passage communicates with the atmosphere passage. When the switching valve switches to communicate the canister connection passage with the pressure detection passage, the pressure regulation portion connected to the pressure-detecting passage forming member pressurizes or reduces a pressure in the fuel tank and a pressure in the canister. The bypass-passage forming member forms a switching-valve bypass passage communicating the canister connection passage with the pressure detection passage to bypass the switching valve. The throttle portion is disposed in the bypass-passage forming member. The pressure detection portion is disposed in the pressure-detecting passage forming member to detect the pressure in the pressure detection passage, and outputs a signal corresponding to the pressure in the pressure detection passage. The housing includes a vibration isolation member and a support portion supporting the vibration isolation member. The pressure regulation portion is supported by the vibration isolation member, the support portion, and the pressure-detecting passage forming member.

According to the fuel-vapor leakage detector, when the pressure regulation portion and the pressure detection portion are integrated as a module to be received in the housing, the pressure regulation portion is supported by the support portion included in the housing. The support portion supports the vibration isolation member which abuts on the pressure regulation portion and suppresses the vibration generated due to an operation of the pressure regulation portion. Therefore, since the pressure regulation portion is supported by the vibration isolation member, the support portion, and the pressure-detecting passage forming member, the pressure regulation portion can preventing from vibrating by its weight. Thus, a noise generated due to the vibration generated in the pressure regulation portion can be reduced.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
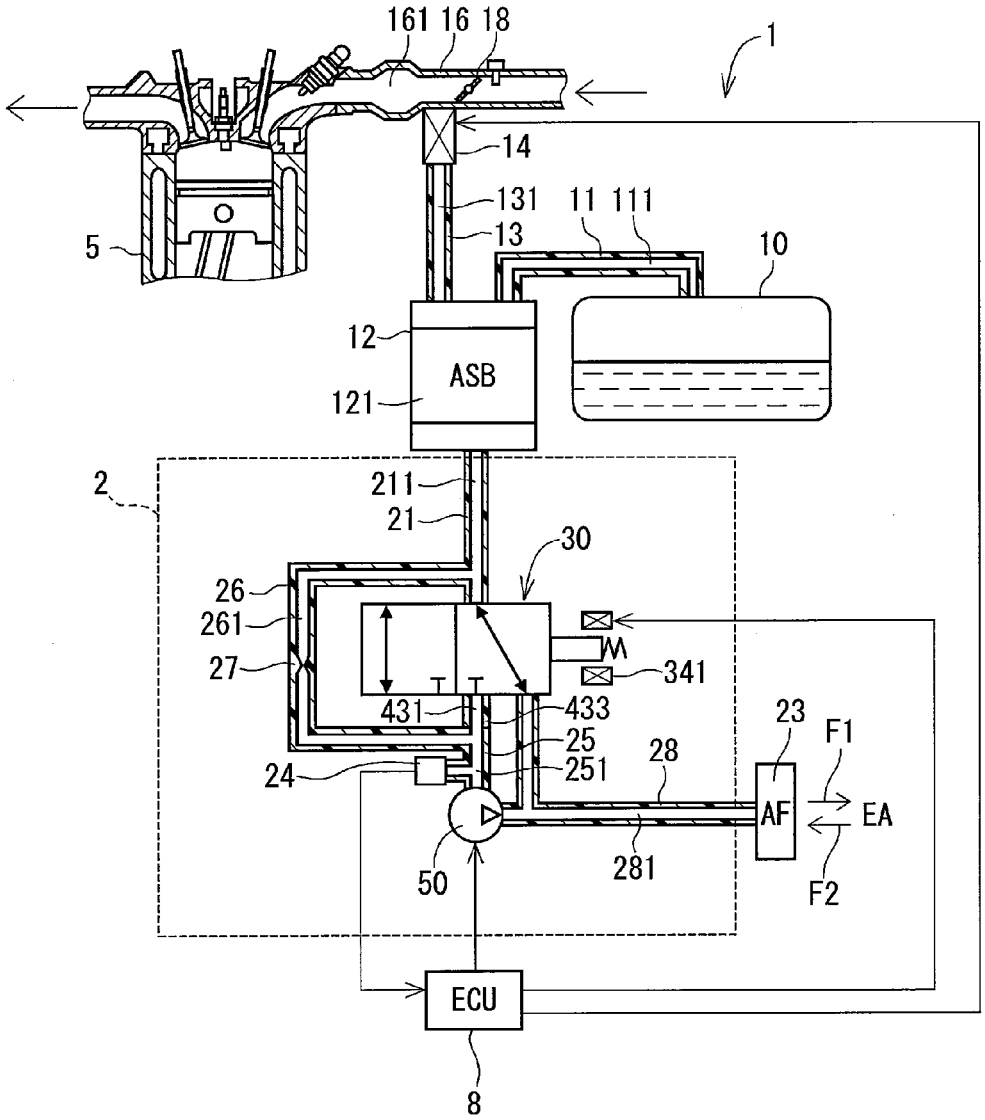
FIG. 1 is a diagram showing an evaporated fuel processor using a fuel-vapor leakage detector according to a first embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, referring to drawings, embodiments of the present disclosure will be described.

(First Embodiment)

Referring to FIGS. 1 to 5, a fuel-vapor leakage detector according to a first embodiment of the present disclosure will be described.

As shown in FIG. 1, an evaporated fuel processor 1 includes a fuel tank 10, a canister 12, a fuel-vapor leakage detector 2, an atmosphere filter (AF) 23, and an ECU 8. In the evaporated fuel processor 1, an evaporated fuel generated in the fuel tank 10 is collected by the canister 12. The evaporated fuel collected by the canister 12 is purged to an intake passage 161 formed by an intake pipe 16 connected with an engine 5.

The fuel tank 10 accumulates a fuel supplied to the engine 5. The fuel tank 10 is connected with the canister 12 through a first purge pipe 11. The first purge pipe 11 forms a first purge passage 111 to communicate with an interior of the fuel tank 10 and an interior of the canister 12.

The canister 12 includes an adsorbent (ASB) 121 collecting the evaporated fuel generated in the fuel tank 10. The canister 12 is connected with the intake pipe 16 through a second purge pipe 13 forming a second purge passage 131. The second purge pipe 13 is provided with a purge valve 14.

The evaporated fuel generated in the fuel tank 10 flows through the first purge passage 111 and is collected by being absorbed by the absorbent 121. The purge valve 14 is an electromagnetic valve. An opening degree of the purge valve 14 is controlled to adjust a quantity of the evaporated fuel that flows from the canister 12 through the second purge passage 131 and is purged downstream of a throttle valve 18 provided in the intake passage 161.

Figure 2:
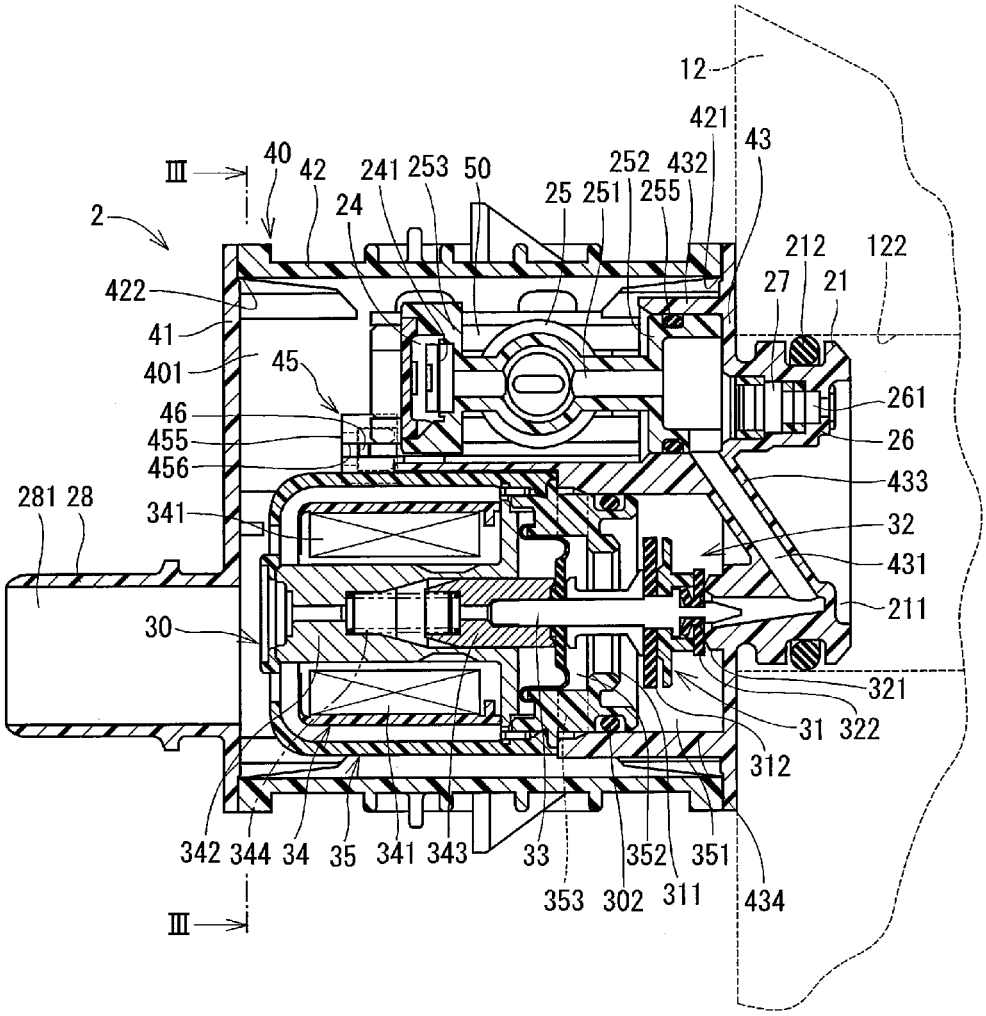
FIG. 2 is a sectional view of the fuel-vapor leakage detector according to the first embodiment.
Figure 3:
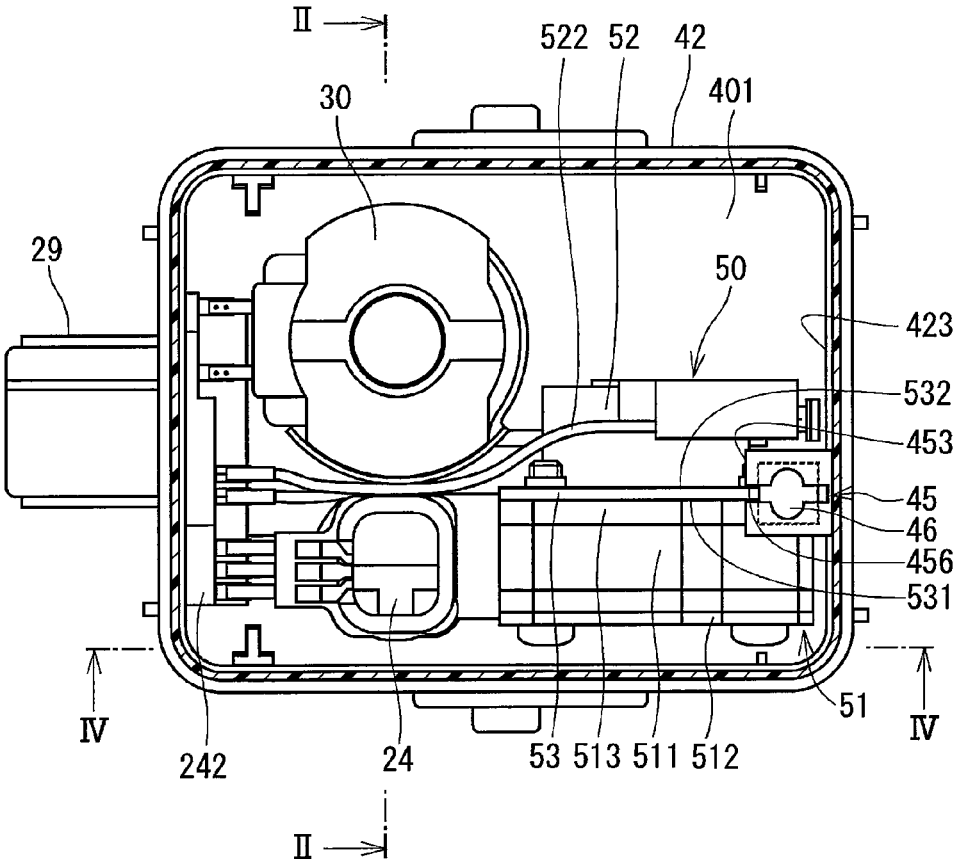
FIG. 3 is a sectional view taken along a line III-III in FIG. 2.
Figure 4:
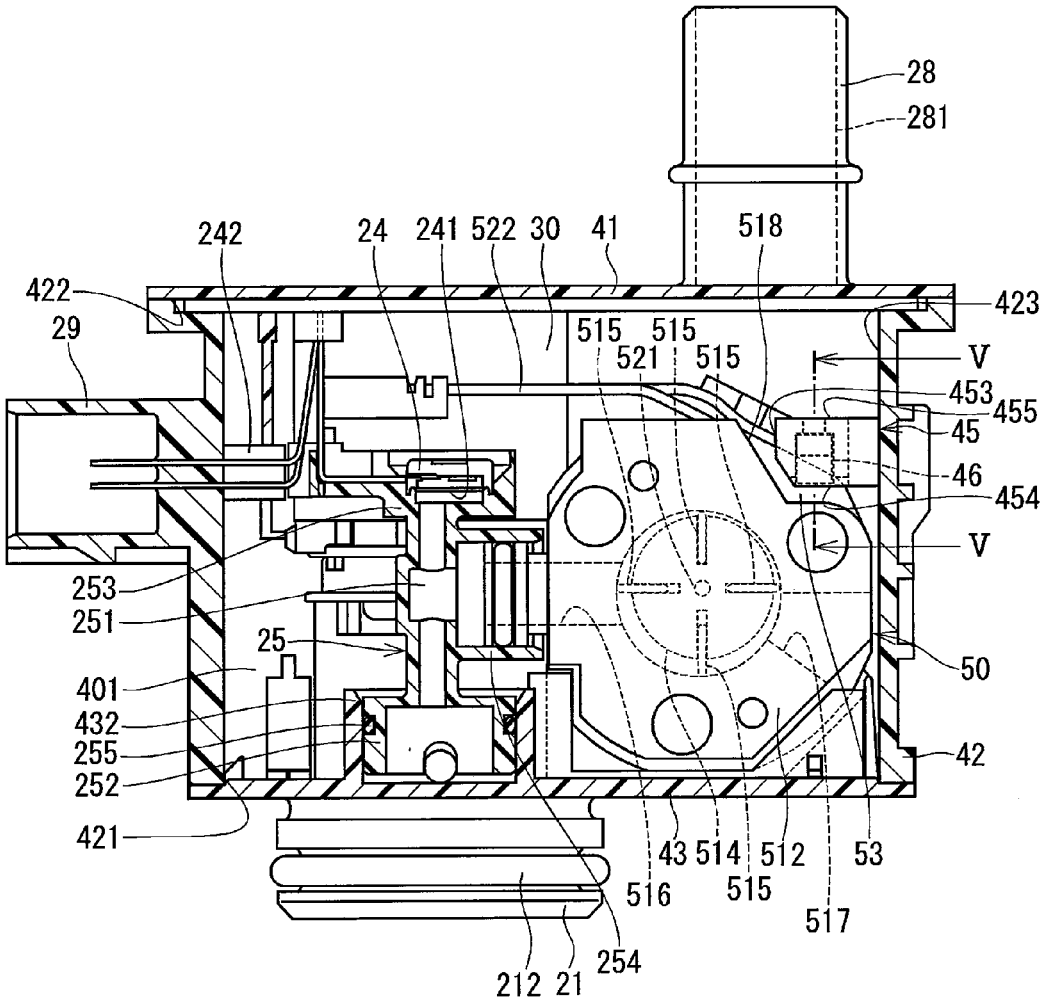
FIG. 4 is a sectional view taken along a line IV-IV in FIG. 3.

As shown in FIGS. 2 to 4, the fuel-vapor leakage detector 2 includes a canister connection pipe 21, a pressure detection pipe 25, a switching-valve bypass pipe 26, a reference orifice 27, an atmosphere-passage pipe 28, a pressure sensor 24, a switching valve 30, a pump 50, and a housing 40. The canister connection pipe 21 corresponds to a canister connection-passage forming member. The pressure detection pipe 25 corresponds to a pressure-detecting passage forming member. The switching-valve bypass pipe 26 corresponds to a bypass-passage forming member. The atmosphere-passage pipe 28 corresponds to an atmosphere-passage forming member. The pressure sensor 24 corresponds to a pressure detection portion. The pump 50 corresponds to a pressure regulation portion. The housing 40 receives the pressure sensor 24, the switching valve 30, and the pump 50.

The canister connection pipe 21 forms a canister connection passage 211 communicating with an interior of the canister 12.

A communication pipe 433 forms a communication passage 431 communicating with an interior of the switching valve 30.

The pressure detection pipe 25 forms a pressure detection passage 251 communicating with an interior of the pump 50.

The switching-valve bypass pipe 26 forms a switching-valve bypass passage 261 communicating the canister connection passage 211 with the communication passage 431 and communicating the canister connection passage 211 with the pressure detection passage 251 so as to bypass the switching valve 30.

The atmosphere-passage pipe 28 forms an atmosphere passage 281 communicating the interior of the pump 50 with an external atmosphere (EA).

According to the present embodiment, the fuel-vapor leakage detector 2 detects a leakage of a fuel vapor of the fuel tank 10 and the canister 12 by reducing a pressure in the fuel tank 10 and the canister 12. The fuel-vapor leakage detector 2 pressurizes the canister 12 to purge a fuel vapor collected by the canister 12 to the intake pipe 16.

The atmosphere filter 23 is connected with an end of the atmosphere-passage pipe 28 adjacent to the external atmosphere. When the fuel vapor is absorbed by the canister 12, when the pump 50 decreases the pressure in the fuel tank 10, or when the fuel is supplied to the fuel tank 10, air in the fuel tank 10 or air in the canister 12 is discharged to the external atmosphere through the atmosphere filter 23. When the fuel vapor absorbed by the canister 12 is supplied to the intake pipe 16, the air is introduced from the external atmosphere to the fuel-vapor leakage detector 2 through the atmosphere filter 23. In this case, the atmosphere filter 23 collects foreign matter included in the introduced air. In addition, an arrow F1 shown in FIG. 1 indicates a flow of a gas flowing out of the atmosphere filter 23. An arrow F2 shown in FIG. 1 indicates a flow of a gas flowing into the atmosphere filter 23.

The ECU 8 includes a microcomputer having a CPU, a RAM, and a ROM. The CPU functions as a calculation portion, and the RAM and the ROM function as a storage portion. The ECU 8 is electrically connected with the pressure sensor 24, the pump 50, a coil 341 included in the switching valve 30, and the purge valve 14. The ECU 8 receives a signal detected by the pressure sensor 24 according to a pressure in the pressure detection passage 251. The ECU 8 outputs a signal controlling a driving of the pump 50 and the purge valve 14. The ECU 8 controls an energization of the coil 341.

Referring to FIGS. 2 to 4, a constitution of the fuel-vapor leakage detector 2 will be described.

According to the present embodiment, as shown in FIG. 2, in the fuel-vapor leakage detector 2, modules such as the pressure sensor 24, the switching valve 30, and the pump 50 are housed in the housing 40. The canister connection pipe 21 is fitted to an attachment hole 122 formed in an outer wall of the canister 12, so as to install the fuel-vapor leakage detector 2.

The housing 40 includes a first housing cover 41, a tubular portion 42, and a second housing cover 43. The housing 40 forms a housing space 401 receiving the pressure sensor 24, the switching valve 30, and the pump 50.

The tubular portion 42 is a rectangular tubular shape and is made of resin. Two surfaces of the tubular portion 42 opposite to each other form a first opening 421 and a second opening 422, respectively.

The first housing cover 41 is a plate shape and is made of resin. The first housing cover 41 covers the second opening 422 opposite to the canister 12. The first housing cover 41 is provided with the atmosphere-passage pipe 28 forming the atmosphere passage 281 communicating the housing space 401 with the external atmosphere.

The second housing cover 43 is a plate shape and is made of resin. The second housing cover 43 covers the first opening 421 adjacent to the canister 12. The second housing cover 43 is provided with the canister connection pipe 21. The canister connection pipe 21 forms the canister connection passage 211 communicating with the interior of the canister 12. An outer periphery of the canister connection pipe 21 is provided with an O-ring 212 abutting on an inner wall of the attachment hole 122 of the canister 12.

An inner wall of the canister connection pipe 21 is provided with the switching-valve bypass pipe 26 forming the switching-valve bypass passage 261, and the communication pipe 433 forming the communication passage 431

The switching-valve bypass passage 261 communicates with the canister connection passage 211 and the pressure detection passage 251 through the reference orifice 27. The reference orifice 27 is a throttle portion, and has a dimension corresponding to an upper limit of an allowable amount of a leakage of the air including the evaporated fuel from the fuel tank 10.

The communication passage 431 communicates with a first connection space 351 formed in the switching valve 30 or the pressure detection passage 251 formed in the pressure detection pipe 25 provided with the pressure sensor 24, according to an operation of the switching valve 30.

The pressure detection pipe 25 has a first end 252 fitted to a recess portion 432 formed in an inner wall of the second housing cover 43. An outer periphery of the first end 252 is provided with an O-ring 255. Thus, the pressure detection pipe 25 is removable and attachable relative to the second housing cover 43.

The pressure sensor 24 is provided on a second end 253 of the pressure detection pipe 25 opposite to the first end 252. The pressure sensor 24 detects a pressure in the pressure detection passage 251 by a sensor surface 241. The pressure sensor 24 outputs a signal corresponding to the pressure to a terminal 242. In this case, the signal is outputted through a connector 29 formed on an outer wall of the tubular portion 42.

The switching valve 30 is an electromagnetic valve, and includes an opening-closing valve 31, a reference valve 32, a valve-shaft member 33, an electromagnetic driving portion 34, and a valve casing 35. The electromagnetic driving portion 34 includes the coil 341 electrically connected with the ECU 8. The valve casing 35 houses the opening-closing valve 31, the reference valve 32, the valve-shaft member 33, and the electromagnetic driving portion 34.

The opening-closing valve 31 includes a first valve seat 311 formed on the valve casing 35, and a washer 312 mounted to the valve-shaft member 33. The reference valve 32 includes a second valve seat 321 formed on the second housing cover 43, and a seating member 322 mounted to an end portion of the valve-shaft member 33. The switching valve 30 is provided with an O-ring 302 placed on an outer periphery of the valve casing 35 positioned between the opening-closing valve 31 and the electromagnetic driving portion 34. Since an end portion of the switching valve 30 provided with the O-ring 302 is fitted to a depression 434 of the second housing cover 43, the switching valve 30 can be installed to or removed from the second housing cover 43.

When the coil 341 is deenergized, the valve-shaft member 33 integrally connected to a movable core 343 is moved toward the canister connection pipe 21 by a biasing force of a spring 344. The biasing force presses the valve-shaft member 33 toward the second valve seat 321. Further, the seating member 322 is seated on the second valve seat 321. Furthermore, the washer 312 is separated from the first valve seat 311. Thus, the canister connection passage 211 communicates with the housing space 401 through the first connection space 351, a second connection space 352, and a communication hole 353 which are included in the valve casing 35. When the coil 341 is deenergized, a flow of an air flowing between the canister connection passage 211 and the pressure detection passage 251 is allowed to flow only through the reference orifice 27.

When the coil 341 is energized, a magnetic attractive force is generated between a stator core 342 and the movable core 343. Thus, the valve-shaft member 33 integrally connected to the movable core 343 is moved toward the atmosphere-passage pipe 28 by cancelling the biasing force of the spring 344. Further, the seating member 322 separated from the second valve seat 321. Furthermore, the washer 312 is seated on the first valve seat 311. Thus, since the first connection space 351 communicates with the communication passage 431, the canister connection passage 211 communicates with the pressure detection passage 251 through the communication passage 431. Further, since the washer 312 is seated on the first valve seat 311, a communication state between the first connection space 351 and the second connection space 352 is interrupted. When the coil 341 is energized, a flow of an air flowing between the canister connection passage 211 and the pressure detection passage 251 is allowed to flow through the communication passage 431, and a flow of an air flowing between the canister connection passage 211 and the housing space 401 is interrupted from flowing through the second connection space 352. In addition, the canister connection passage 211 always communicates with the pressure detection passage 251 through the reference orifice 27 without respect to an energization state of the coil 341.

The pump 50 is a vane pump, and is driven by a brushless direct-current motor. The pump 50 includes a pump portion 51, a motor portion 52, and an attachment portion 53.

The pump portion 51 includes a cam ring 511, a first pump cover 512, a second pump cover 513, a rotor 514, and plural vanes 515.

The cam ring 511 is a tubular shape. The first pump cover 512 and the second pump cover 513 are provided to cover openings of a pair of surfaces of the cam ring 511. In this case, the surfaces are opposite to each other. The cam ring 511 rotatably receives the rotor 514. The cam ring 511 forms two holes communicating an interior of the cam ring 511 with an exterior of the cam ring 511. A first cam-ring hole 516 communicates with the pressure detection passage 251. A second cam-ring hole 517 communicates with the housing space 401.

The rotor 514 integrally rotates with a shaft 521 included in the motor portion 52. The vanes 515 are arranged radially outward of the rotor 514 at the same interval.

The vanes 515 are inserted into grooves included in the rotor 514. When the rotor 514 rotates, the vanes 515 are movable in a radially-outward direction. A radially-outward end surface of each vane 515 is slidable relative to inner wall of the cam ring 511. The rotor 514 and the vanes 515 correspond to a rotating member.

The motor portion 52 includes the shaft 521 extending toward the interior of the cam ring 511 from the motor portion 52. The motor portion 52 is power supplied from external through a wiring 522. The motor portion 52 outputs a rotational torque driving the shaft 521.

The attachment portion 53 is a flat plate shape and is made of metal, and is placed between the pump portion 51 and the motor portion 52. The attachment portion 53 has a first end surface 531 provided with a pump portion 51. The first end surface 531 corresponds to a pump-side end surface. As shown in FIG. 4, a part of the first end surface 531 is exposed to external through a recession 518 formed on a side wall of the pump portion 51. The attachment portion 53 has a second end surface 532 provided with the motor portion 52. The second end surface 532 corresponds to a motor-side end surface. Since a dimension of the motor portion 52 is relatively smaller than a dimension of the attachment portion 53, a part of the second end surface 532 is exposed to external.

The attachment portion 53 forms a through hole communicating an interior of the motor portion 52 with an interior of the pump portion 51. In addition, the through hole is not shown. The shaft 521 is inserted into the through hole. The through hole is formed at a position shifted from a center of the interior of the cam ring 511. Therefore, the rotor 514 connected to the shaft 521 rotates at a position shifted from the center of the interior of the cam ring 511. Since the rotor 514 rotates at an eccentric position shifted relative to the center of the interior of the cam ring 511, the pump 50 compresses or expands a fluid such as the gas or the air.

According to the present embodiment, in the fuel-vapor leakage detector 2, the tubular portion 42 has an inner wall 423 provided with a support portion 45 and an elastic member 46. The elastic member 46 corresponds to a vibration isolation member. Referring to FIGS. 2 to 5, the support portion 45 will be described.

The support portion 45 is provided on the inner wall 423 of the tubular portion 42, and is placed at position in the vicinity of the pump 50. The support portion 45 is a made of resin and is a substantially cuboid shape, and is integrally bonded to the tubular portion 42.

Figure 5:
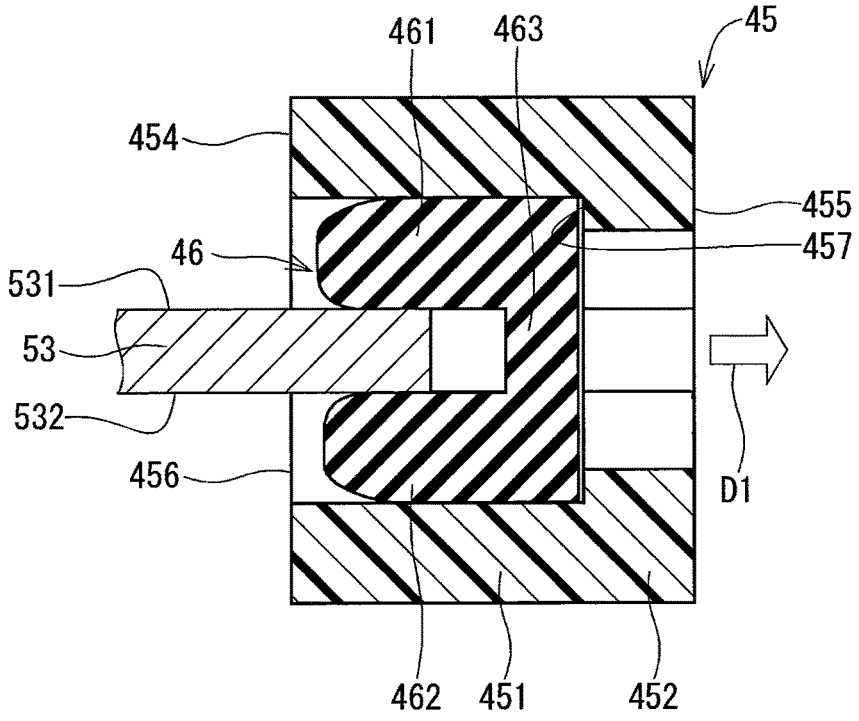
FIG. 5 is a sectional view taken along a line V-V in FIG. 4.

As shown in FIG. 5, the support portion 45 includes a first inner-diameter portion 451 and a second inner-diameter portion 452. The first inner-diameter portion 451 has an inner diameter greater than an inner diameter of the second inner-diameter portion 452. The support portion 45 further includes a first outer wall 453, a second outer wall 454, a third outer wall 455, and an opening 456. The first outer wall 453 is opposite to a connection surface of the support portion 45 connected to the inner wall 423 of the tubular portion 42. The second outer wall 454 and the third outer wall 455 are connected with the connection surface and the first outer wall 453. The opening 456 is formed in the second outer wall 454 and the third outer wall 455 and is a groove shape. As shown in FIG. 5, when the attachment portion 53 is inserted into the opening 456, a gap is generated between the inner wall forming the opening 456, the first end surface 531, and the second end surface 532.

The first inner-diameter portion 451 is placed at a position of the support portion 45 adjacent to the pump 50. The first inner-diameter portion 451 receives the elastic member 46 that is made of rubber. An interior of the first inner-diameter portion 451 communicates with external through the opening 456 formed on the second outer wall 454.

The second inner-diameter portion 452 is placed at a position of the support portion 45 opposite to the pump 50. An interior of the second inner-diameter portion 452 communicates with the interior of the first inner-diameter portion 451. The interior of the second inner-diameter portion 452 communicates with external through the opening 456 formed on the third outer wall 455.

A step surface 457 is formed between the first inner-diameter portion 451 and the second inner-diameter portion 452.

As shown in FIG. 5, the elastic member 46 has a cross section that is a substantially U shape. The elastic member 46 includes a pump-side abutting portion 461, a motor-side abutting portion 462, and a connection portion 463. The pump-side abutting portion 461 and the motor-side abutting portion 462 extend toward the second outer wall 454 from two ends of the connection portion 463.

When the attachment portion 53 is inserted into the support portion 45 in a direction along an arrow D1 as shown in FIG. 5, the pump-side abutting portion 461 abuts on the first end surface 531 of the attachment portion 53.

When the attachment portion 53 is inserted into the support portion 45 in a direction along the arrow D1 as shown in FIG. 5, the motor-side abutting portion 462 abuts on the second end surface 532 of the attachment portion 53.

The connection portion 463 is connected to the pump-side abutting portion 461 and the motor-side abutting portion 462 and is placed at a position opposite to an end into which the attachment portion 53 is inserted. The connection portion 463 abuts on the step surface 457 to limit a position of the elastic member 46 relative to the support portion 45.

Hereafter, an assembly process of the fuel-vapor leakage detector will be described.

Firstly, the pressure sensor 24, the switching valve 30, and the pump 50 are mounted to the second housing cover 43 to form a module received by the housing space 401. In this case, as shown in FIG. 4, the pump portion 51 is connected to a connection part 254 of the pressure detection pipe 25 where the pressure sensor 24 is provided.

Secondly, the module is mounted to the tubular portion 42. In this case, the pump 50 is inserted into the tubular portion 42 from the first opening 421 of the tubular portion 42. Further, the attachment portion 53 is inserted into the first inner-diameter portion 451 of the support portion 45. Then, the attachment portion 53 is interposed between the pump-side abutting portion 461 and the motor-side abutting portion 462. In addition, the elastic member 46 is arranged in the support portion 45 before the module is mounted to the tubular portion 42. However, the elastic member 46 may be inserted into the support portion 45 through the opening 456 formed on the third outer wall 455 after the attachment portion 53 is inserted into the support portion 45.

Finally, the first housing cover 41 is mounted to the second opening 422 of the tubular portion 42.

Hereafter, effects of the fuel-vapor leakage detector 2 will be described.

When a predetermined time period has elapsed since the engine 5 mounted to a vehicle is stopped, the ECU 8 is activated by a soak timer that is not shown. Firstly, a detection of an atmosphere pressure of the external atmosphere is executed to correct an error generated due to a height of the vehicle that is parked. When the coil 341 is deenergized, the atmosphere passage 281 communicates with the canister connection passage 211 through the switching valve 30. The canister connection passage 211 communicates with the pressure detection passage 251 through the switching-valve bypass passage 261. Since the pressure detection passage 251 communicates with the external atmosphere, the atmosphere pressure is detected by the pressure sensor 24 provided in the pressure detection pipe 25. When the detection of the atmosphere pressure is completed, the ECU 8 calculates the height of the vehicle based on the detected pressure.

Secondly, when the pump 50 is energized, the pressure in the pressure detection passage 251 is reduced. When the pressure in the pressure detection passage 251 is reduced, the atmosphere flows into the pressure detection passage 251 through the atmosphere passage 281, the switching valve 30, the canister connection passage 211, and the switching-valve bypass passage 261. Since the air (external atmosphere) flowing into the pressure detection passage 251 is throttled by the reference orifice 27, the pressure in the pressure detection passage 251 becomes lower. The pressure in the pressure detection passage 251 becomes constant after reducing at a predetermined pressure correlative to an area of an opening of the reference orifice 27. The pressure of the pressure detection passage 251 detected by the pressure sensor 24 is stored as a reference pressure.

When the reference pressure is detected, the coil 341 of the switching valve 30 is energized. In this case, the switching valve 30 shuts the communication state between the canister connection passage 211 and the atmosphere passage 281 and allows the communication state between the canister connection passage 211 and the pressure detection passage 251. When the canister connection passage 211 communicates with the pressure detection passage 251, the pressure in the pressure detection passage 251 becomes equal to that of the fuel tank 10 and that of the canister 12.

Since the canister connection passage 211 communicates with the pressure detection passage 251, the pressure in the fuel tank 10 and the pressure in the canister 12 are reduced by the pump 50.

In this case, when the pressure in the pressure detection passage 251 is less than the reference pressure, it is determined that a leakage of the gas including the fuel vapor of the fuel tank 10 or the canister 12 is less than or equal to an allowable quantity. That is, when the pressure in the fuel tank 10 and the pressure in the canister 12 are less than the reference pressure, an entering of the air from an exterior of the fuel tank 10 or the canister 12 into an interior of the fuel tank 10 or the canister 12 is not generated, or a flow rate of the air entering the interior of the fuel tank 10 or the canister 12 is less than or equal to a flow rate that can pass through the reference orifice 27. Thus, an air tight of the fuel tank 10 and the canister 12 is sufficiently ensured.

When the pressure in the fuel tank 10 and the pressure in the canister 12 exceed the reference pressure, it is determined that the leakage of the gas including the fuel vapor of the fuel tank 10 or the canister 12 is greater than the allowable quantity. That is, when the pressure in the fuel tank 10 and the pressure in the canister 12 exceed the reference pressure, the air enters the fuel tank 10 and the canister 12 from external while the pressure of the fuel tank 10 and the pressure of the canister 12 are reduced. Thus, the air tight of the fuel tank 10 and the canister 12 is insufficiently ensured.

When a determination of the air tight of the fuel tank 10 and the canister 12 is completed, the switching valve 30 is deenergized, the reference pressure is detected again, and then the pump 50 is deenergized. The ECU 8 terminates an operation of the pressure sensor 24 and terminates a fuel-vapor leakage detection process, after the pressure in the pressure detection passage 251 is recovered to the atmosphere pressure.

(a) According to the present embodiment, in the fuel-vapor leakage detector 2, when the module is mounted to the tubular portion 42, the attachment portion 53 of the pump 50 is inserted into the support portion 45 formed on the inner wall 423 of the tubular portion 42. The support portion 45 receives the elastic member 46 abutting on the attachment portion 53. The elastic member 46 prevents a vibration generated by an operation of the pump 50 from being transmitted to the tubular portion 42. Since the pump 50 is connected to the second housing cover 43 through the pressure detection pipe 25 and is connected to the tubular portion 42 through the elastic member 46 and the support portion 45, the pump 50 is supported by two members. Therefore, the vibration transmitted from the pump 50 to the housing 40 is suppressed, and a noise generated due to a vibration of the housing 40 can be reduced.

(b) According to Japanese Patent No. 4543437, when a pump is formed as a module, in an elastic sheet included in the pump, a pump portion is supported by a pressure detection pipe provided with a pressure sensor. A vibration transmitted from a motor portion to the pump portion can be suppressed by the elastic sheet. However, a vibration of the pump portion cannot be prevented from being transmitted to a housing through the pressure detection pipe.

According to the present embodiment, in the fuel-vapor leakage detector 2, the attachment portion 53 provided by the pump portion 51 and the motor portion 52 abuts on the elastic member 46. Therefore, vibrations transmitted from both the pump portion 51 and the motor portion 52 can be suppressed. Thus, it is unnecessary to provide an elastic sheet for preventing a vibration between the pump portion and the motor portion, a member number is reduced, and the noise radiated out of the housing 40 can be reduced.

(c) According to the present embodiment, the elastic member 46 abuts on the attachment portion 53 by the pump-side abutting portion 461 and the motor-side abutting portion 462. Therefore, when one of the pump-side abutting portion 461 and the motor-side abutting portion 462 loses elasticity due to usage environment of the fuel-vapor leakage detector 2, the vibration of the pump 50 can be suppressed by the other one of the pump-side abutting portion 461 and the motor-side abutting portion 462. Thus, the noise radiated out of the housing 40 due to the vibration can be further reduced.

(d) According to the present embodiment, the elastic member 46 includes the connection portion 463 connected to both the pump-side abutting portion 461 and the motor-side abutting portion 462. Therefore, when one of the pump-side abutting portion 461 and the motor-side abutting portion 462 loses elasticity due to usage environment of the fuel-vapor leakage detector 2, it can be prevented that the one of the pump-side abutting portion 461 and the motor-side abutting portion 462 is removed from the support portion 45.

(e) According to the present embodiment, since the pump-side abutting portion 461 and the motor-side abutting portion 462 are integrally bonded to each other as one member through the connection portion 463, a man-hour for assembling the fuel-vapor leakage detector can be reduced with respect to a fuel-vapor leakage detector in which the pump-side abutting portion 461 and the motor-side abutting portion 462 are separately provided.

(f) According to the present embodiment, the connection portion 463 is placed at a position in the support portion 45 where the connection portion 463 is inserted into the support portion 45 in a direction parallel to the direction in which the attachment portion 53 is inserted into the support portion 45. Therefore, when the elastic member 46 loses elasticity due to usage environment of the fuel-vapor leakage detector 2 and the attachment portion 53 cannot abut on the elastic member 46, it is prevented that the attachment portion 53 moves toward the first housing cover 41. Thus, a movement of the pump 50 can be prevented from moving toward the first housing cover 41.

(Second Embodiment)

Figure 6:
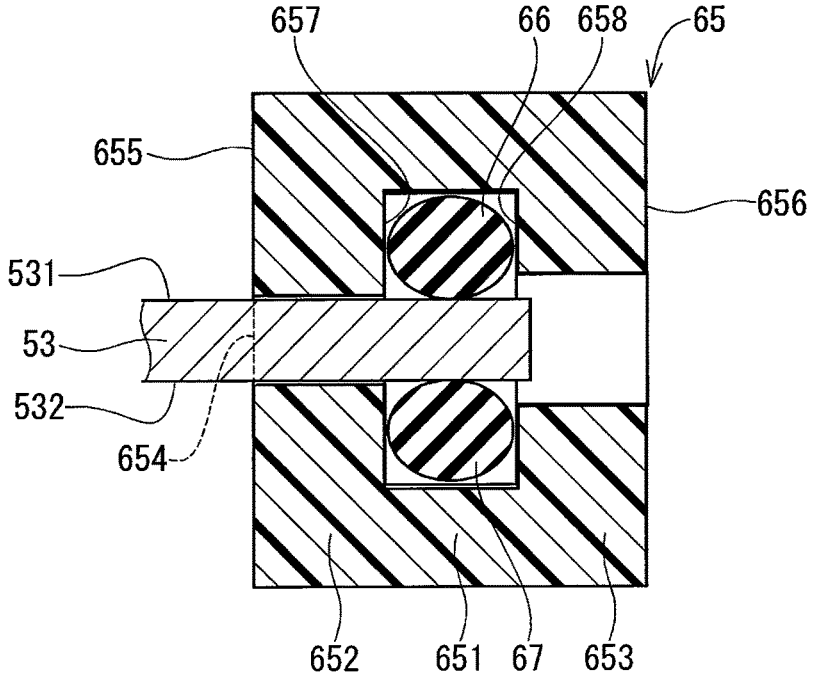
FIG. 6 is a sectional view of a part of the fuel-vapor leakage detector according to a second embodiment of the present disclosure.

Referring to FIG. 6, the fuel-vapor leakage detector 2 according to a second embodiment of the present disclosure will be described. According to the second embodiment, a shape of the support portion and a shape of the elastic member are different from those in the first embodiment. The substantially same parts and the components as the first embodiment are indicated with the same reference numeral and the same description will not be reiterated.

In the fuel-vapor leakage detector 2, a support portion 65 is provided on the inner wall 423 of the tubular portion 42, and is placed at position in the vicinity of the pump 50.

As shown in FIG. 6, the support portion 65 includes a first inner-diameter portion 651, a second inner-diameter portion 652, and a third inner-diameter portion 653. The first inner-diameter portion 651 has an inner diameter greater than an inner diameter of the second inner-diameter portion 652, and the inner diameter of the second inner-diameter portion 652 is greater than an inner diameter of the third inner-diameter portion 653. The support portion 65 further includes an opening 654 that is provided as the same as the opening 456 of the first embodiment.

The first inner-diameter portion 651 is placed at a position substantially adjacent to a center of the support portion 65. The first inner-diameter portion 651 receives a first elastic member 66 and a second elastic member 67. The first elastic member 66 and the second elastic member 67 are made of rubber and correspond to the vibration isolation member.

The second inner-diameter portion 652 is placed at a position of the support portion 65 adjacent to the pump 50. An interior of the second inner-diameter portion 652 communicates with an interior of the first inner-diameter portion 651. The interior of the second inner-diameter portion 652 communicates with external through the opening 654 formed on a first outer wall 655. When the module is mounted to the tubular portion 42, the attachment portion 53 is pressed to fit to the interior of the second inner-diameter portion 652.

The third inner-diameter portion 653 is placed at a position of the support portion 65 opposite to the pump 50. An interior of the third inner-diameter portion 653 communicates with the interior of the first inner-diameter portion 651. The interior of the second inner-diameter portion 652 communicates with external through the opening 654 formed on a second outer wall 656 opposite to the first outer wall 655.

A first step surface 657 is formed between the first inner-diameter portion 651 and the second inner-diameter portion 652. A second step surface 658 is formed between the first inner-diameter portion 651 and the third inner-diameter portion 653.

When the attachment portion 53 is pressed to fit to the support portion 65, the first elastic member 66 abuts on the first end surface 531 of the attachment portion 53. When the attachment portion 53 is pressed to fit to the support portion 65, the second elastic member 67 abuts on the second end surface 532 of the attachment portion 53.

Movements of the first elastic member 66 and the second elastic member 67 are limited by the first step surface 657 and the second step surface 658 in the first inner-diameter portion 651.

According to the present embodiment, when the attachment portion 53 is pressed to fit to the support portion 65, an inner wall of the second inner-diameter portion 652, the first elastic member 66, and the second elastic member 67 abut on the first end surface 531 and the second end surface 532. Therefore, the pump 50 is supported by two members which are the pressure detection pipe 25 and the support portion 65. The first elastic member 66 and the second elastic member 67 prevent the vibration of the pump 50 from being transmitted to the tubular portion 42. Since the attachment portion 53 is fixed by being pressed to fit to the support portion 65, the pump 50 prevents from vibrating by its weight. Thus, according to the present embodiment, effects (a) to (c) can be achieved.

(Other Embodiment)

According to the above embodiments, the leakage of the fuel vapor is detected after the pump reduces the pressure in the fuel tank and the pressure in the canister. However, the leakage of the fuel vapor may be detected after the pressure in the fuel tank and the pressure in the canister are pressurized.

According to the above embodiments, the elastic member abuts on the attachment portion. However, the elastic member is not limited to abut on the attachment portion of the pump. The elastic member may abut on the pump portion or the motor portion.

According to the above embodiments, two elastic members abut on the attachment portion. However, only one elastic member may abut on the attachment portion.

According to the above embodiments, the elastic member is made of rubber. However, the elastic member is not limited to be made of rubber. The elastic member may be made of a material that has elasticity and can suppress the vibration of the pump.

According to the above embodiments, the pump is vane pump. However, the pump is not limited and may be a pump of another type.

According to the above embodiments, the elastic member is made of rubber. However, the elastic member is not limited to be made of rubber. The elastic member may be made of a material that can suppress the vibration of the pump.

The present disclosure is not limited to the embodiments mentioned above, and can be applied to various embodiments within the spirit and scope of the present disclosure.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel-vapor leakage detector configured to detect a leakage of a fuel vapor of a fuel tank and a canister, the canister being configured to collect the fuel vapor in the fuel tank, the fuel-vapor leakage detector comprising:

a housing;

a canister connection-passage forming member defining a canister connection passage that communicates with the canister;

an atmosphere-passage forming member defining an atmosphere passage that communicates with external atmosphere;

a pressure-detecting passage forming member defining a pressure detection passage that is fluidly connected to the housing and can communicate with the canister connection passage;

a switching valve configured to selectively switch between a first communication state in which the canister connection passage communicates with the pressure detection passage and a second communication state in which the canister connection passage communicates with the atmosphere passage;

a pressure regulation portion connected to the pressure-detecting passage forming member, the pressure regulation portion being configured to pressurize or reduce a pressure in the fuel tank and a pressure in the canister when the switching valve switches to communicate the canister connection passage with the pressure detection passage;

a bypass-passage forming member defining a switching-valve bypass passage that communicates the canister connection passage with the pressure detection passage to bypass the switching valve;

a throttle portion disposed in the bypass-passage forming member; and a pressure detection portion disposed at a position communicating with the pressure-detecting passage forming member to detect the pressure in the pressure detection passage, the pressure detection portion being configured to output a signal corresponding to the pressure in the pressure detection passage, wherein the housing includes a vibration isolation member and a support portion supporting the vibration isolation member, the pressure regulation portion is supported by the vibration isolation member, the support portion, and the pressure-detecting passage forming member, the pressure regulation portion includes a motor portion configured to output a rotational torque, a pump portion that receives a rotational member, the pump portion (i) being configured to suction air in the fuel tank and the canister and then discharge the air into external atmosphere, and (ii) being configured to suction the external atmosphere and then discharge the external atmosphere into the fuel tank and the canister, when the rotational torque is transmitted to the rotational member, and an attachment portion disposed between the pump portion and the motor portion, the pump portion and the motor portion are mounted to the attachment portion;

the vibration isolation member abuts on the attachment portion; and the vibration isolation member abuts on a first end surface of the attachment portion adjacent to the pump portion and a second end surface of the attachment portion adjacent to the motor portion.

2. The fuel-vapor leakage detector according to claim 1, wherein the vibration isolation member is received in the support portion, and the vibration isolation member includes a pump-side abutting portion abutting on the first end surface, a motor-side abutting portion abutting on the second end surface, and a connection portion disposed in the support portion into which the attachment portion is inserted, the connection portion being connected to the pump-side abutting portion and the motor-side abutting portion.

3. The fuel-vapor leakage detector according to claim 1, wherein the vibration isolation member has a U-shaped cross section perpendicular to the first end surface.

4. The fuel-vapor leakage detector according to claim 1, wherein the vibration isolation member is outside of any flow path of the fuel-vapor leakage detector.

* * * * *